US008790063B2

(12) United States Patent
Kim

(10) Patent No.: US 8,790,063 B2
(45) Date of Patent: Jul. 29, 2014

(54) ATTACHMENT MOUNTING APPARATUS FOR MOVABLE WORK VEHICLE

(75) Inventor: Joong-Ho Kim, Okcheon-gun (KR)

(73) Assignee: Daeho Co., Ltd., Okcheon-gun, Chungcheongbuk-do (KR)

( * ) Notice: Subject to any disclaimer, the term of this patent is extended or adjusted under 35 U.S.C. 154(b) by 665 days.

(21) Appl. No.: 13/003,852

(22) PCT Filed: Jul. 6, 2009

(86) PCT No.: PCT/KR2009/003672

§ 371 (c)(1),
(2), (4) Date: Jan. 12, 2011

(87) PCT Pub. No.: WO2010/008151

PCT Pub. Date: Jan. 21, 2010

(65) Prior Publication Data

US 2011/0116903 A1 May 19, 2011

(30) Foreign Application Priority Data

Jul. 15, 2008 (KR) ..... 10-2008-0068405
Mar. 25, 2009 (KR) ..... 10-2009-0025533

(51) Int. Cl.
*B66C 23/00* (2006.01)
*B66F 9/00* (2006.01)
*E02F 3/00* (2006.01)

(52) U.S. Cl.
USPC ..... 414/686

(58) Field of Classification Search
USPC ..... 414/686, 724, 785, 723; 37/468; 172/272; 294/119.1
See application file for complete search history.

(56) References Cited

U.S. PATENT DOCUMENTS 3,876,092 A * 4/1975 MacDonald ..... 414/686
3,987,562 A * 10/1976 Deen et al. ..... 37/231
4,266,819 A * 5/1981 Pemberton ..... 294/197
4,266,906 A * 5/1981 Langenfeld et al. ..... 414/686
4,906,160 A * 3/1990 Kaufman et al. ..... 414/686

FOREIGN PATENT DOCUMENTS

GB 2110643 A * 6/1983
JP 03-072121 A 3/1991
JP 2006-191835 A 7/2006
KR 10-0321009 B1 1/2002
KR 20-0368490 Y1 11/2004
KR 20-0413756 Y1 4/2006
KR 20-0440007 Y1 5/2008

* cited by examiner

*Primary Examiner* — Stephen Vu
(74) *Attorney, Agent, or Firm* — John K. Park; Park Law Firm

(57) ABSTRACT

A loader attachment mounting apparatus for movable work vehicles is provided, which is used for mounting a work attachment, such as a bale gripper, a bucket or a hook, to the front end of a loader that is movably installed on the front surface of the movable work vehicles, such as a tractor. A loader equipped with the loader attachment mounting apparatus is also provided. In the loader attachment mounting apparatus, an attachment can be easily attached to and easily detached from the attachment mounting apparatus and the attachment mounted to the loader can be easily movable to the left and right, thus improving work efficiency and work reliability of the movable work vehicles. The apparatus includes left and right attachment coupling brackets connected to the loader, and an attachment transfer device including left and right attachment coupling units connected to the attachment coupling brackets.

15 Claims, 9 Drawing Sheets

(a)

(b)

(c)

ATTACHMENT MOUNTING APPARATUS FOR MOVABLE WORK VEHICLE

TECHNICAL FIELD

The present invention relates, in general, to a loader attachment mounting apparatus for movable work vehicles, which is used for mounting a work attachment, such as a bale gripper, a bucket or a hook, to the front end of a loader movably mounted to the front surface of the movable work vehicles, such as a tractor, in such a way that the loader can be rotatable upwards and downwards, and relates to a loader equipped with the loader attachment mounting apparatus and, more particularly, to a loader attachment mounting apparatus for movable work vehicles and a loader equipped with the attachment mounting apparatus, in which an attachment can be easily attached to and easily detached from the attachment mounting apparatus and the attachment mounted to the loader can be easily movable to the left and right, thus improving work efficiency and work reliability of the movable work vehicles.

BACKGROUND ART

In the related art, there have been proposed and used a variety of movable work vehicles, such as tractors, in which a front loader is mounted to the front end of a movable work vehicle and is used for moving, loading or unloading a weight thing. The conventional loader has been typically equipped with a bucket and has been typically used for loading or unloading soil or farmyard manure.

However, in recent years, because the business of agriculture and livestock farming becomes middle and large-scaled, work using a variety of mechanical implements has been required due to an increase in the personnel expenses for manual farming work and thereby a variety of work attachments capable of executing various farming works have been proposed and used.

To accomplish the object, a loader attachment mounting structure capable of attaching or detaching a variety of work attachments, such as a bale gripper, a bucket and a hook, to the front end of the loader has been proposed.

However, the conventional loader attachment mounting structure is problematic in that it is not easy to mount an attachment to the loader using the structure and, further, because loader manufacturers produce and market loaders having different sizes, the conventional loader attachment mounting structure may not compatibly mount a variety of attachments to the loaders having different sizes.

Further, when a movable work vehicle equipped with an attachment loaded with a weight thing moves on a slope, for example, when the vehicle loaded with bagged rice-straw held by a bale gripper or loaded with soil in a bucket moves on a slope, the vehicle may lose the center of gravity due to the loaded weight and thereby may be overturned.

Further, because the conventional loader attachment mounting structure mounts the attachment to the loader such that the attachment is immobilized in lateral directions, the movable work vehicle, such as a tractor, may repeatedly move forwards and backwards so as to align the attachment with a desired loading or unloading place, thus reducing work efficiency and increasing work time while executing loading or unloading work.

DISCLOSURE

Technical Problem

Accordingly, the present invention has been made keeping in mind the above problems occurring in the related art, and is intended to provide a loader attachment mounting apparatus for movable work vehicles, which is mounted to the front ends of a loader of a movable work vehicle, such as a tractor, and has a structure capable of selectively, compatibly and easily mount a variety of attachments, such as a pair of bale grippers, a pair of fork pockets, a pair of bag hangers and a bucket frequently used in farming and livestock farming, to an attachment coupling unit of the attachment mounting apparatus.

Further, the present invention serves to provide a loader attachment mounting apparatus for movable work vehicles, in which left and right attachment coupling units to which an attachment is mounted can be laterally moved in the same direction or in opposite directions, so that designated works of respective attachments can be easily executed (when a pair of bale grippers or a pair of fork pockets as the attachment are mounted to the left and right attachment coupling units, the left and right attachment coupling unit having the attachment can be moved in opposite directions, thus easily adjusting the interval between the bale grippers or between the fork pockets and thereby efficiently executing desired work) and, further, because the entire part of the pair of attachment coupling units can be laterally moved to the left or right, a variety of works can be efficiently executed.

Further, the present invention serves to provide a loader attachment mounting apparatus for movable work vehicles, in which, even when a movable work vehicle, such as a tractor, moves on a slope while being loaded with a weight thing and leans to a side on the slope due to the loaded weight, the entire part of a pair of attachment coupling units equipped with an attachment can be laterally moved to a direction opposite to the leaning direction of the movable work vehicle and can retain the center of gravity, thus being free of the problem of overturning of the movable work vehicle even when the vehicle moves on the slope.

Further, the present invention serves to provide a loader attachment mounting apparatus for movable work vehicles, in which the entire part of the pair of attachment coupling units can be laterally moved to the left or right, thus easily executing desired loading or unloading work without repeatedly moving the movable work vehicle forwards and backwards so as to align an attachment with a desired loading or unloading place or without adjusting the position of the attachment relative to the desired loading or unloading place, and thereby reducing work time and maximizing work efficiency.

Further, the present invention serves to provide a loader attachment mounting apparatus for movable work vehicles, which is provided with a plurality of mounting holes capable of compatibly mounting a variety of loaders having different widths manufactured by respective manufacturers when attaching a loader to a movable work vehicle, such as a tractor.

Further, the present invention serves to provide a loader for movable work vehicles, which is equipped with the loader attachment mounting apparatus for movable work vehicles.

Further, the present invention serves to provide an attachment mounting apparatus mounted to a loader for movable work vehicles, which is improved in such a way that, when it is required to attach a bucket to the attachment mounting apparatus, an operator can easily attach the bucket to the attachment mounting apparatus by manipulating the movement of the attachment mounting apparatus while sitting in a cab.

Technical Solution

In an aspect, the present invention provides a loader attachment mounting apparatus for movable work vehicles, which is mounted to left and right front ends of a loader mounted to a front surface of a movable work vehicle, such as a tractor, and is used for attaching or detaching an attachment to or from the loader, the attachment mounting apparatus comprising: left and right attachment coupling brackets connected on first surfaces thereof to the left and right front ends of the loader; and an attachment transfer device including left and right attachment coupling units, which are connected to second surfaces of the left and right attachment coupling brackets and attach or detach the attachment, and are laterally movable in the same direction or in opposite directions.

In the present invention, when the left and right attachment coupling units are laterally moved in the same direction or in the opposite directions, the left and right attachment coupling units may be moved by the same displacement.

Further, in the present invention, the attachment transfer device may comprise: left and right upper mounting parts and left and right lower mounting parts mounted to upper and lower parts of the second surfaces of the left and right attachment coupling brackets; a hydraulic cylinder unit comprising: a pair of hydraulic cylinder extendible rods being laterally movable to left and right along a pair of driving lateral guide rails fixed in the left and right upper mounting parts; and a first hydraulic cylinder and a second hydraulic cylinder moving the hydraulic cylinder extendible rods in lateral directions; a lateral moving unit comprising a pair of lateral moving sliders being laterally movable to left and right along a pair of driven lateral guide rails fixed in the left and right lower mounting parts; left and right attachment coupling units having a structure for attaching and detaching the attachment, and vertically connecting the pair of hydraulic cylinder extendible rods to the pair of lateral moving sliders in such a way that the pair of hydraulic cylinder extendible rods can be laterally moved by extendible motions of the first and second hydraulic cylinders and thereby can laterally move the lateral moving sliders connected to the hydraulic cylinder extendible rods.

Further, the pair of driving lateral guide rails of the hydraulic cylinder unit may be laterally arranged with a lateral gap defined between them, while the pair of driven lateral guide rails of the lateral moving unit may be laterally arranged with a vertical gap defined between them.

In the present invention, one of the pair of driving lateral guide rails, which is laterally moved along one of the driving lateral guide rails close to the upper mounting parts, may be fixed by the attachment coupling units to one of the lateral moving sliders, which is laterally moved along a lower one of the driven lateral guide rails, while one of the hydraulic cylinder extendible rods, which is laterally moved along one of the pair of driving lateral guide rails remote from the upper mounting parts, may be fixed to a remaining one of the lateral moving sliders, which is laterally moved along an upper one of the driven lateral guide rails, by the attachment coupling units.

Further, in the present invention, lower surfaces of the pair of driving lateral guide rails may be partially and axially open, while remaining parts of the lower surfaces thereof may be closed, and front surfaces (surfaces to which the attachment is being attached) of the pair of driven lateral guide rails may be partially and axially opened, while remaining parts of the front surfaces thereof may be axially closed.

Further, the attachment coupling unit may be provided with an upper locking hook and a lower locking hook, so that the attachment can be mounted to the attachment coupling unit. Further, the upper or lower locking hook may attach or detach the attachment by projecting or retracting a restraining jaw using a releasing lever elastically biased by an elastic member.

Further, the present invention provides a loader attachment mounting apparatus for movable work vehicles, which is mounted to left and right front ends of a loader mounted to a front surface of a movable work vehicle, such as a tractor, and is used for attaching or detaching an attachment, the attachment mounting apparatus comprising: left and right attachment coupling brackets connected on first surfaces thereof to the left and right front ends of the loader; and an attachment transfer device including: left and right upper mounting parts and left and right lower mounting parts connected to upper and lower portions of second surfaces of the left and right attachment coupling brackets; and left and right attachment coupling units attaching and detaching the attachment and being laterally movable by a pair of hydraulic cylinders, wherein the upper mounting parts or the lower mounting parts are connected to the attachment coupling brackets by mounting pins and further comprise: a plurality of mounting holes capable of realizing a width adjustment, so that the attachment transfer device can be compatibly mounted to a variety of loaders having different width according to manufacturers.

Here, the attachment may be a pair of fork pockets, a pair of bale grippers, a pair of bag hangers, a bucket or a fork.

Further, the present invention provides a loader for movable work vehicles, which is mounted to a front surface of a movable work vehicle, such as a tractor, the loader comprising: an attachment mounting apparatus mounted to left and right front ends of the loader, the attachment mounting apparatus comprising: left and right attachment coupling brackets connected on first surfaces thereof to the left and right front ends of the loader; and an attachment transfer device including left and right attachment coupling units, which are connected to second surfaces of the left and right attachment coupling brackets and attach or detach the attachment, and are laterally movable in the same direction or in opposite directions.

Further, the present invention provides an attachment mounting apparatus mounted to a loader for movable work vehicles, which is mounted to left and right front ends of the loader mounted to a front surface of a movable work vehicle, such as a tractor, and is used for attaching or detaching an attachment to or from the loader, the attachment mounting apparatus comprising: left and right attachment coupling brackets connected on first surfaces thereof to the left and right front ends of the loader; left and right attachment coupling units mounted to the left and right attachment coupling brackets at locations opposite to the loader and attaching or detaching the attachment; and an attachment transfer device for laterally moving the left and right attachment coupling units in the same direction or in opposite directions, wherein the attachment coupling units is provided with a hollow part for allowing an operator of the movable work vehicle to see an upper locking hook, which is being locked to the attachment, through the hollow part while sitting in a cab of the movable work vehicle.

Further, in the present invention, the upper locking hook may be configured such that a front end thereof is inclined.

Further, the attachment coupling unit may further comprise: sub-locking hooks provided in left and right sides of the upper locking hook locked to the attachment.

Advantageous Effects

As described above, the loader attachment mounting apparatus for movable work vehicles and the loader equipped with the attachment mounting apparatus according to the present invention is advantageous in that it can easily and compatibly mount a variety of attachments, such as a pair of bale grippers, a pair of fork pockets, a pair of bag hangers and a bucket frequently used in farming and livestock farming, to the loader, and can laterally move the entire part of the left and right attachment coupling units, to which the attachment is being attached, in the same direction or in opposite directions, so that designated works of respective attachments can be easily executed (when a pair of bale grippers or a pair of fork pockets as the attachment are mounted to the left and right attachment coupling units, the left and right attachment coupling unit having the attachment can be moved in opposite directions, thus easily adjusting the interval between the bale grippers or between the fork pockets and thereby efficiently executing desired work) and, further, because the entire part of the pair of attachment coupling units can be laterally moved to the left or right, a variety of works can be efficiently executed.

Further, the attachment mounting apparatus of the present invention is advantageous in that, even when the movable work vehicle, such as a tractor, moves on a slope while being loaded with a weight thing and leans to a side on the slope due to the loaded weight, the entire part of the pair of attachment coupling units equipped with the attachment can be laterally moved to a direction opposite to the leaning direction of the movable work vehicle and can retain the center of gravity, thus being free of the problem of overturning of the movable work vehicle even when the vehicle moves on the slope.

Further, the present invention is advantageous in that the entire part of the pair of attachment coupling units can be laterally moved to the left or right, so that the present invention can easily execute desired loading or unloading work without repeatedly moving the movable work vehicle forwards and backwards so as to align the attachment with a desired loading or unloading place or without adjusting the position of the attachment relative to the desired loading or unloading place, thus reducing work time and maximizing work efficiency.

Further, the attachment mounting apparatus of the present invention is advantageous in that it can be easily attached to or detached from the loader of a movable work vehicle, such as a tractor, and can be compatibly used with a variety of loaders having different widths according to manufacturers and can easily attach a variety of attachments to the loader.

Further, the attachment mounting apparatus mounted to the loader for movable work vehicles according to the present invention is advantageous in that the attachment coupling unit is configured to have the hollow part, thus allowing the operator of the movable work vehicle to confirm the attached state of the attachment (bucket) through the hollow part while sitting in the cab of the vehicle and thereby allowing the operator to more easily attach the bucket to the attachment mounting apparatus.

Further, the attachment mounting apparatus mounted to the loader for movable work vehicles according to the present invention is advantageous in that the upper locking hook of the attachment coupling unit is configured to have an inclined structure, thus allowing the operator of the movable work vehicle to more easily confirm the attached state of the attachment (bucket) while sitting in the cab of the vehicle.

DESCRIPTION OF REFERENCE CHARACTERS OF IMPORTANT PARTS

Figure 1:
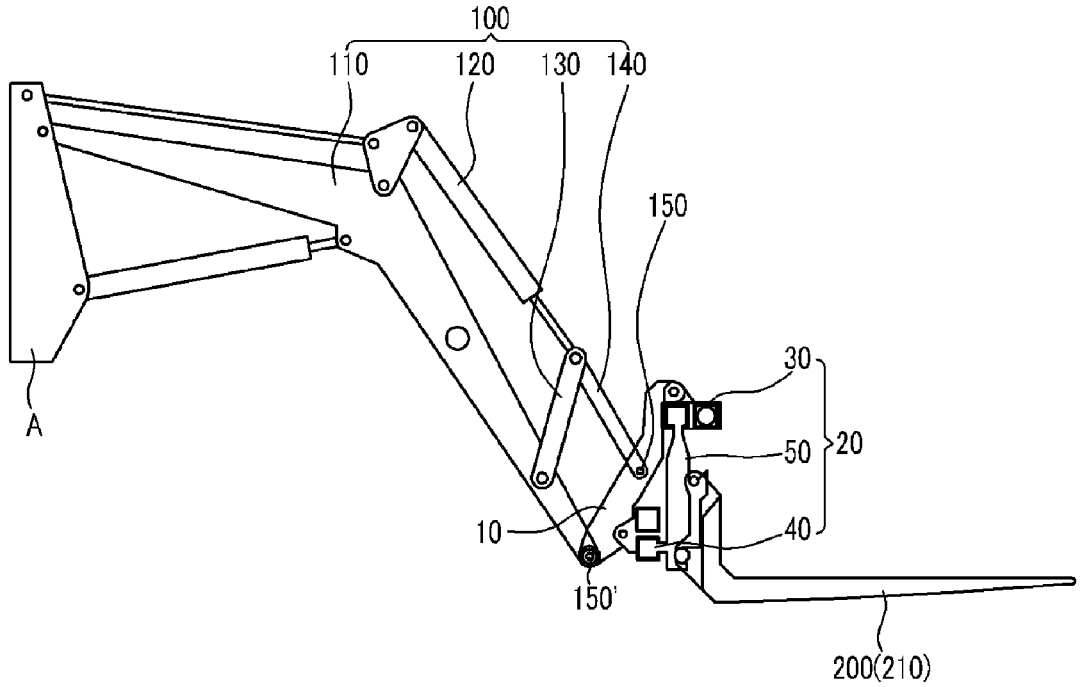
FIG. 1 is a side view illustrating a state in which an attachment (fork pocket) is mounted to a loader attachment mounting apparatus for movable work vehicles according to an embodiment of the present invention.

A: movable work vehicle
100: loader
110: roader boom
120: loader hydraulic cylinder
130: connection link
140: extension link
150, 150: loader front end
10: attachment coupling bracket
14, 14': loader mounting hole
20: attachment transfer device
21: upper mounting part
22: lower mounting part
23, 25: mounting pin
24: mounting holes
30: hydraulic cylinder unit
31, 32: driving lateral guide rail
33, 34: hydraulic cylinder extendible rods
35: first hydraulic cylinder
36: second hydraulic cylinder
40: lateral moving unit
41, 42: driven guide rail
43, 44: lateral moving slider
45: hydraulic pressure line
46: hydraulic pressure controller
47: hydraulic pressure connection jack
48: hydraulic cylinder shaft
50: attachment coupling unit
51: upper locking hook
52: lower locking hook
53: elastic member
54: restraining jaw

55: releasing lever
56: hollow part
57: sub-locking hook
60: fixed frame
200: attachment
210: fork pocket
220: bale gripper
230: bag hanger
240: bucket
221, 231, 242: upper locking pin
221, 231, 242: lower locking pin
243: width adjusting link
244: self-locking pin

MODE FOR INVENTION

Hereinbelow, preferred embodiments of a loader attachment mounting apparatus for movable work vehicles and a loader equipped with the attachment mounting apparatus according to the present invention will be described in detail with reference to the accompanying drawings.

Figure 2:
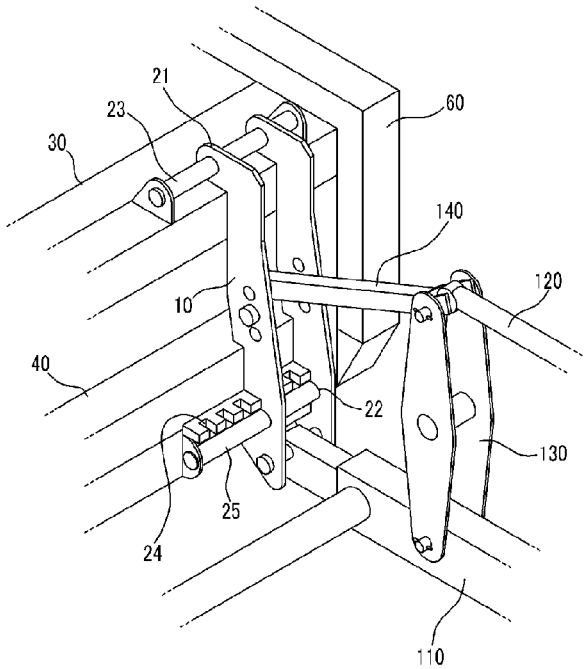
FIG. 2 is a view illustrating a connected junction between an attachment coupling bracket and an attachment transfer device according to the present invention in detail.
Figure 3:
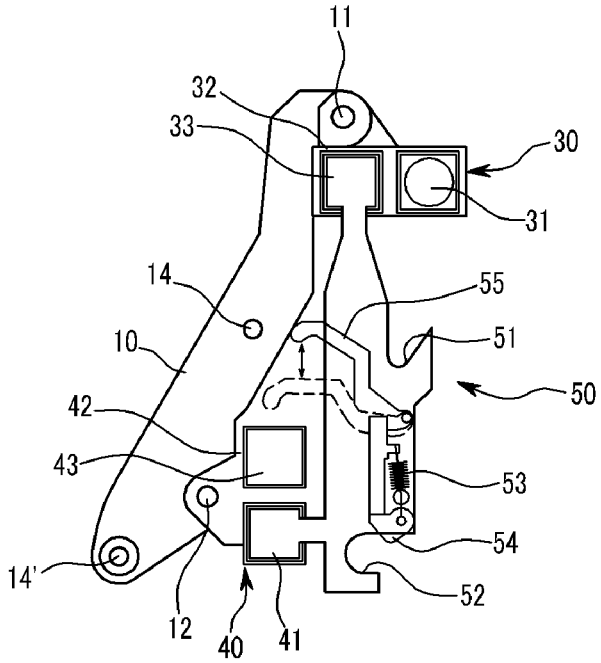
FIG. 3 is a right side view illustrating the attachment mounting apparatus of the present invention and FIG. 4 is a left side view illustrating the attachment mounting apparatus.
Figure 4:
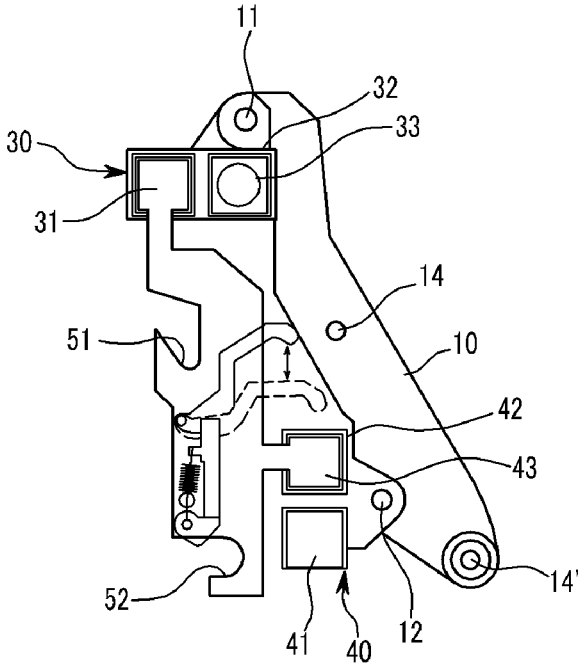
Figure 5:
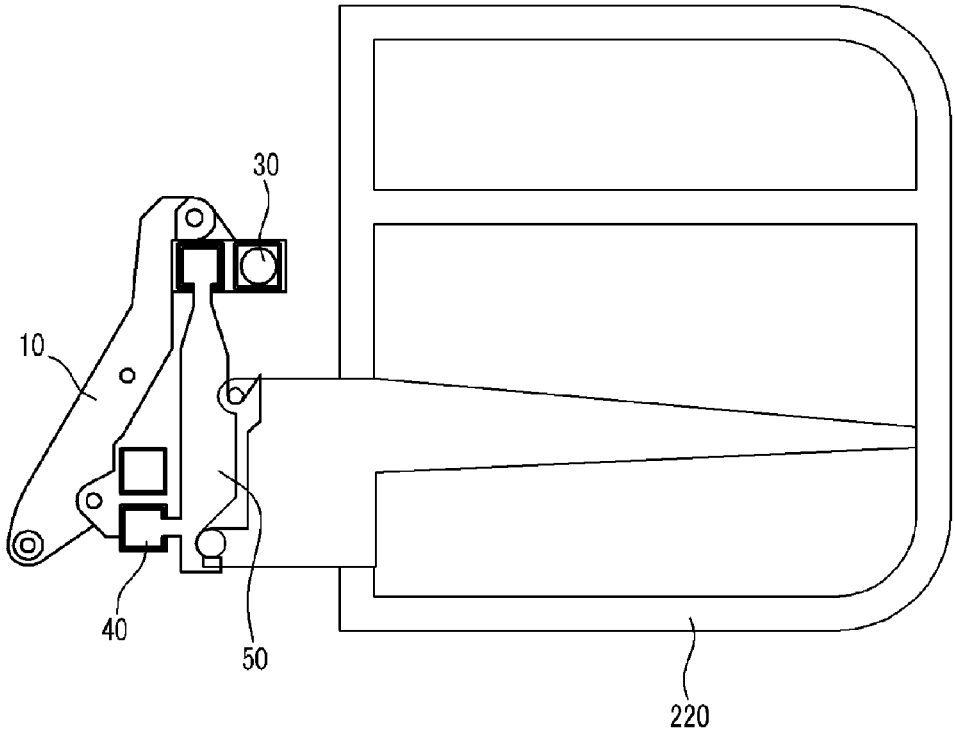
FIGS. 5 through 7 are side views illustrating states in which a bale gripper, a bag hanger or a bucket is mounted to the attachment mounting apparatus of the present invention, respectively.
Figure 6:
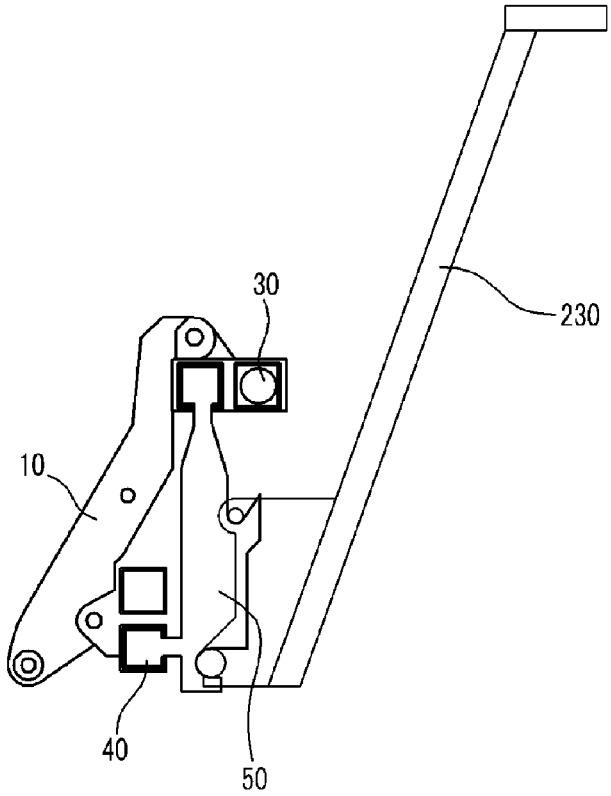
Figure 7:
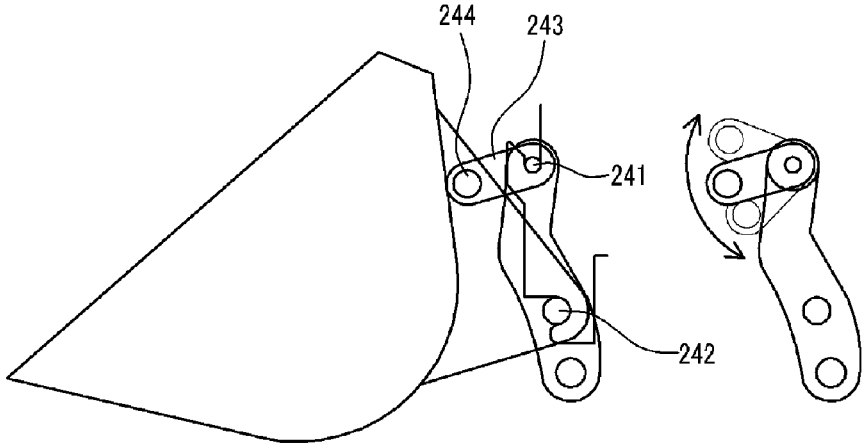
Figure 8:
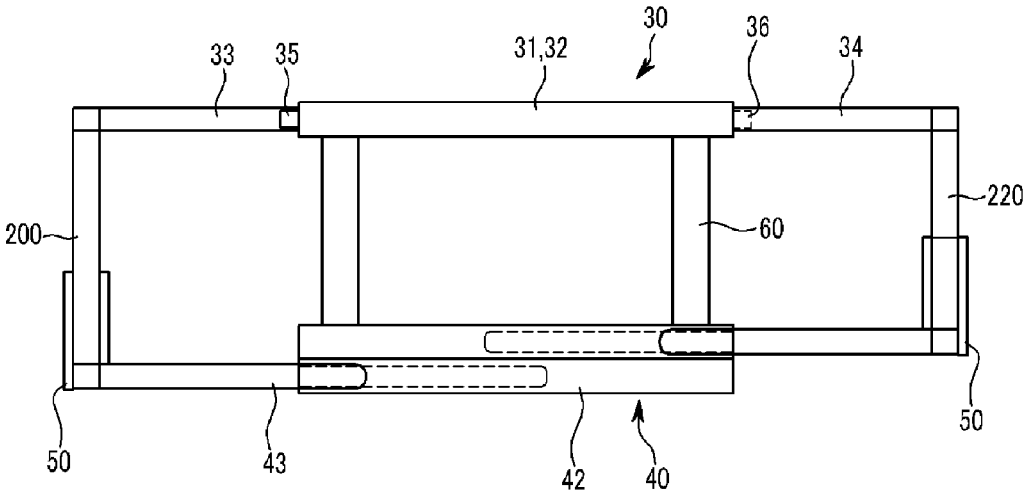
FIG. 8 is a front view illustrating a state in which a hydraulic cylinder extendible rod of the present invention has been fully extended.
Figure 9:
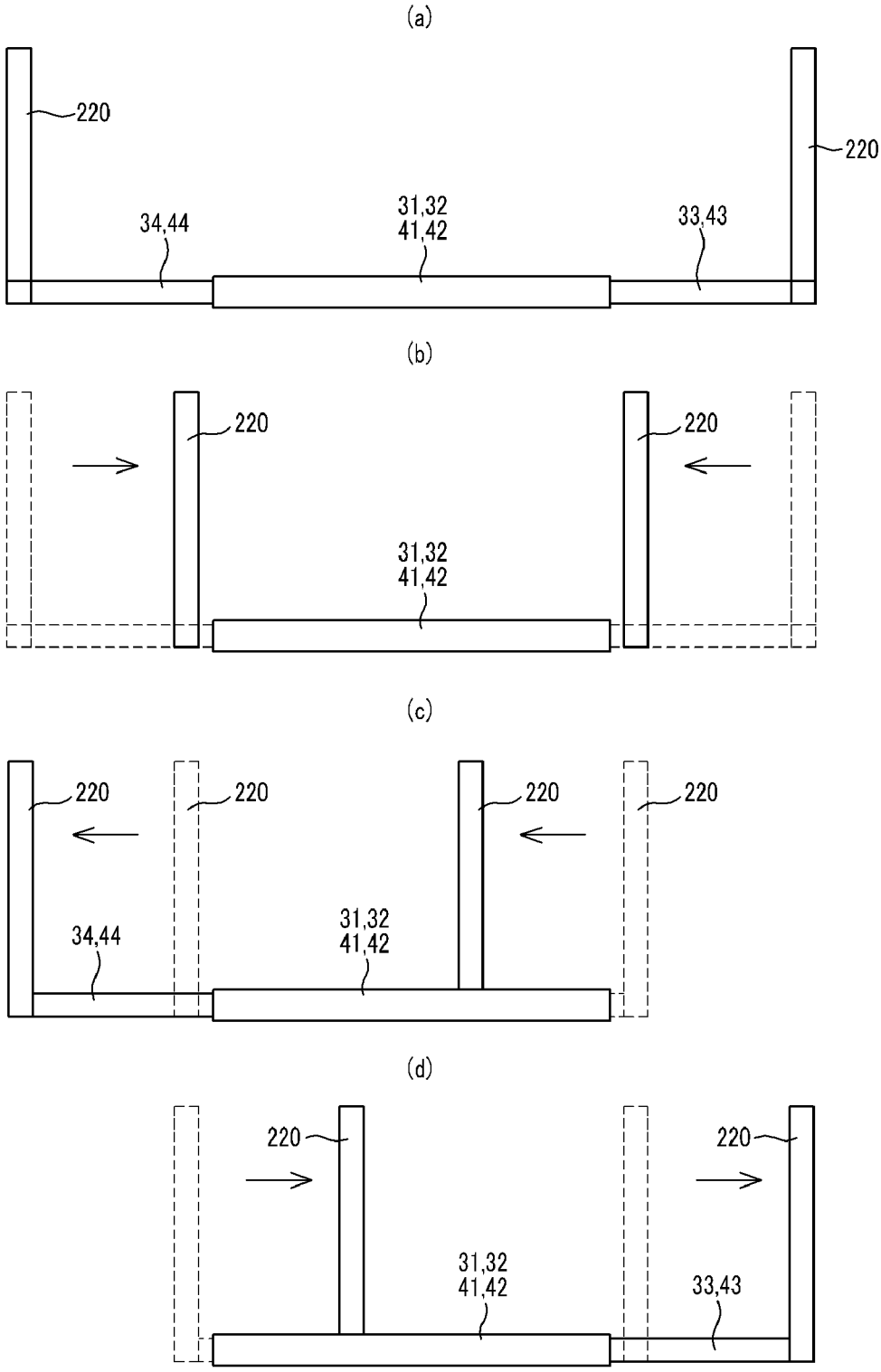
FIG. 9 is a view schematically illustrating the operation of the attachment mounting apparatus according to the present invention.
Figure 10:
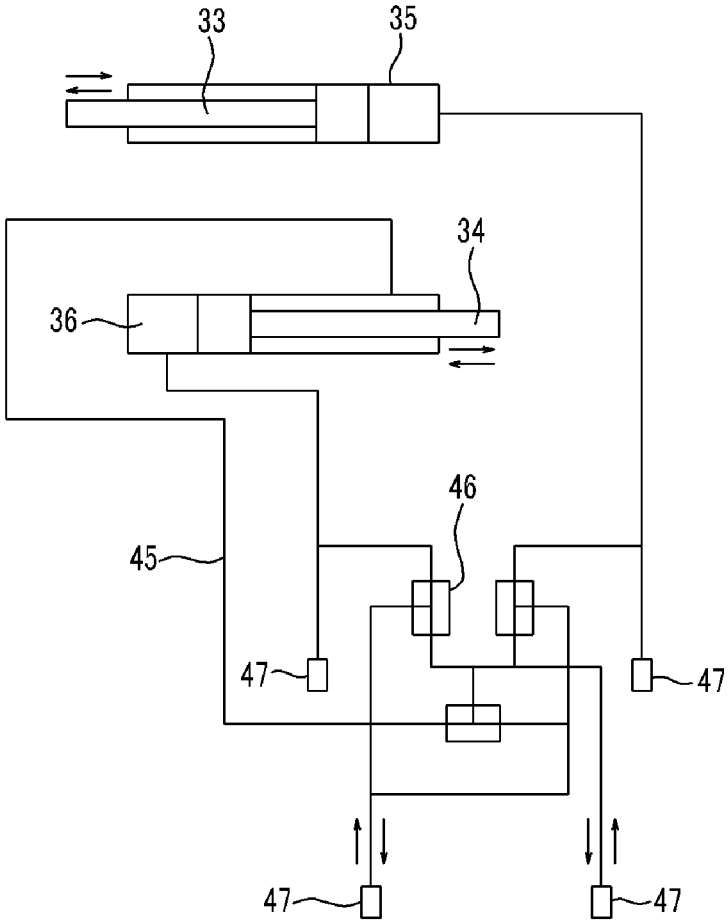
FIG. 10 is a circuit diagram of a hydraulic cylinder according to an embodiment of the present invention.

FIG. 1 is a side view illustrating a state in which an attachment is mounted to a loader attachment mounting apparatus for movable work vehicles according to the present invention. FIG. 2 is a view illustrating a connected junction between an attachment coupling bracket and an attachment transfer device according to the present invention in detail. FIG. 3 is a right side view illustrating the attachment mounting apparatus of the present invention. FIG. 4 is a left side view illustrating the attachment mounting apparatus. FIGS. 5 through 7 are side views illustrating states in which a bale gripper, a bag hanger or a bucket is mounted to the attachment mounting apparatus of the present invention, respectively. FIG. 8 is a front view illustrating a state in which a hydraulic cylinder extendible rod of the present invention has been fully extended. FIG. 9 is a view schematically illustrating the operation of the attachment mounting apparatus according to the present invention. FIG. 10 is a circuit diagram of a hydraulic cylinder according to an embodiment of the present invention.

As shown in FIG. 1, the loader attachment mounting apparatus for movable work vehicles according to the present invention is attached to the left and right front ends of a loader 100 mounted to the front surface of a movable work vehicle (A), such as a tractor, and is removably equipped with an attachment 200, such as a pair of bale grippers, a pair of fork pockets, a pair of bag hangers, a bucket, a fork, which is typically used in farming work and livestock raising work.

The loader 100 mounted to the front surface of the movable work vehicle (A), such as the tractor, is a typical loader, which includes a loader boom 110 and a loader hydraulic cylinder 120 for rotating the loader boom 110 upwards and downwards. The loader 100 further includes a connection link 130, which is linked to the front end of an actuating rod of the loader hydraulic cylinder 120 at a predetermined position of the loader boom 110, and an extension link 140, which is connected to and extends forwards from the front end of the actuating rod of the loader hydraulic cylinder 120. The connection link 130 and the extension link 140 are provided in each side of the loader boom 110, so that the loader 100 has a pair of connection links 130 spaced apart from each other at a predetermined interval and a pair of extension links 140 spaced apart from each other at a predetermined interval.

The loader attachment mounting apparatus for movable work vehicles according to the present invention is mounted to the left and right front ends of the loader 100. In other words, the loader attachment mounting apparatus is mounted both to the front ends 150' of the extension links 140 provided in the left and right sides of the loader and to the front end 150' of the loader boom 110.

The loader attachment mounting apparatus for movable work vehicles includes left and right attachment coupling brackets 10, which are connected to upper and lower front ends 150 and 150' provided in the left and right sides of the loader, and an attachment transfer device 20 connected to second surfaces of the attachment coupling brackets 10.

The left and right attachment coupling brackets 10 are provided in middle portions thereof with respective loader mounting holes 14 and 14' at locations corresponding to the upper and lower front ends 150 and 150' of the loader 100, so that the brackets 10 can be coupled by pins to the upper and lower front ends 150 and 150' provided in the left and right sides of the loader. Further, the left and right attachment coupling brackets 10 are provided with respective upper locking holes and respective lower locking holes in the predetermined portions of the second surfaces thereof, so that the left and right attachment coupling brackets 10 can be connected by pins to both an upper mounting part 21 and a lower mounting part 22 which are provided in an attachment transfer device 20 at locations corresponding to the width interval between the left and right front ends of the loader 100.

As shown in FIG. 2, the upper mounting part 21 is mounted to the attachment coupling brackets 10 by a mounting pin 23 which passes through the upper locking holes. The lower mounting part 22 is provided with a plurality of mounting holes 24 in such a way that the attachment coupling brackets 10 can be inserted into associated holes among the plurality of mounting holes 24, which are spaced apart from each other by a distance corresponding to the width of the left and right attachment coupling brackets 10. After inserting the attachment coupling brackets 10 into the associated holes, the attachment coupling brackets 10 can be coupled to the lower mounting part 22 using a mounting pin 25. Because the loader attachment mounting apparatus of the present invention includes the plurality of mounting holes 24 as described above, the apparatus is advantageous in that it can be compatibly used with a variety of loaders without using additional elements or devices even when the loaders have different widths according to manufacturers.

In FIG. 2, the mounting holes 24 are provided in the lower mounting part 22. However, it should be understood that the mounting holes 24 may be provided in the upper mounting part 21. Further, the structure of the mounting holes 24 may be freely altered if the structure allows a user to adjust the width of the holes 24 as desired.

As described above, even when it is required to mount the loader attachment mounting apparatus of the present invention to one of a variety of loaders having different widths according to manufacturers, the loader can be easily inserted into and connected to associated holes of the mounting holes 24, so that the attachment mounting apparatus of the present invention can be compatibly mounted to a variety of loaders having different widths according to manufacturers.

Hereinbelow, the construction of the attachment transfer device 20 will described.

The attachment transfer device 20 includes left and right upper mounting parts 21 and left and right lower mounting parts 22 at locations corresponding to the left and right attachment coupling brackets 10, that is, the locations corresponding to the width of the loader 100, so that the left and right upper mounting parts 21 and the left and right lower mounting parts 22 can be connected to the left and right attachment coupling brackets 10.

The left and right upper mounting parts 21 are connected to a hydraulic cylinder unit 30, which is provided with a pair of driving lateral guide rails 31 and 32, a pair of hydraulic cylinder extendible rods 33 and 34 that are laterally movable along the driving lateral guide rails 31 and 32, and a first hydraulic cylinder 35 and a second hydraulic cylinder 36 for laterally moving the hydraulic cylinder extendible rods 33 and 34. Meanwhile, the left and right lower mounting parts 22 are connected to a lateral moving unit 40 which is provided with a pair of fixed driven lateral guide rails 41 and 42, and a pair of lateral moving sliders 43 and 44 that are laterally movable along the pair of driven lateral guide rails 41 and 42.

In the above description, the attachment transfer device is mounted to the left and right attachment coupling brackets 10 using both the left and right upper mounting parts 21 and the left and right lower mounting parts 22. However, it should be understood that the attachment transfer device 20 may be mounted to the left and right attachment coupling brackets 10 using a single left and right mounting part without using the separated upper and lower mounting parts if the single left and right mounting part can securely mount the attachment transfer device 20 to the left and right attachment coupling brackets 10.

The attachment transfer device 20 further includes left and right attachment coupling units 50. The left and right attachment coupling units 50 vertically connect the pair of hydraulic cylinder extendible rods 33 and 34 to the pair of lateral moving sliders 43 and 44 in such a way that the hydraulic cylinder extendible rods 33 and 34 can be laterally movable by the extendible motions of the hydraulic cylinders 35 and 36. Therefore, the hydraulic cylinder extendible rods 33 and 34 can laterally move the lateral moving sliders 43 and 44 connected thereto so that an attachment 200 can be attached to or detached from the attachment transfer device.

When the left and right attachment coupling units 50 are moved in lateral directions, the left and right attachments 200 mounted to the attachment coupling units 50 can be laterally moved to the left and right.

The structure and process of mounting an attachment 200 to the attachment coupling units 50 will be described hereinbelow with reference to FIG. 3, FIG. 4 and FIGS. 5 through 7.

Each of the attachment coupling units 50 includes both an upper locking hook 51 and a lower locking hook 52 for mounting the attachment 200 to the attachment coupling units 50. The upper locking hook 51 has a grooved shape which is open in the top thereof, so that, when an upper locking pin 221, 231, 241 of the attachment 200 is inserted into the groove of the upper locking hook 51, the locking pin 221, 231, 241 can be reliably retained in the hooked stated inside the groove of the upper locking hook 51 due to the weight. The lower locking hook 52 has a grooved shape which is open in the front thereof and receives a lower locking pin 222, 232, 242 of the attachment 200 in the groove.

To hold or release the lower locking pin 222, 232, 242 of the attachment 50 in or from the lower locking hook 52, a releasing lever 55 elastically biased by an elastic member 53 is manipulated so as to project or retract a restraining jaw 54. Therefore, the attachment 50 can be easily mounted to the attachment coupling units 50.

FIG. 5 illustrates a bale gripper 220 as the attachment 200 mounted to the attachment coupling units 50. FIG. 6 illustrates a bag hanger 220 as the attachment 200 mounted to the attachment coupling units 50. FIG. 7 illustrates a bucket 230 as the attachment 200 mounted to the attachment coupling units 50.

To mount the attachment 200 to the attachment coupling unit 50, the upper locking pin 221, 231, 241 of the attachment 100 is inserted into the groove of the upper locking hook 51 and, thereafter, the lower locking pin 222, 232, 242 of the attachment 200 is inserted into the front open groove of the lower locking hook 52. Thereafter, the restraining jaw 54 is projected by pulling the releasing lever 55, thus securely holding the lower locking pin 222, 232, 242 of the attachment 200 in the lower locking hook 52.

To remove the attachment 200 from the attachment coupling units 50, the above-mentioned mounting process is executed in the reverse order.

When a bucket 240 is used as the attachment 200, as shown in FIG. 7, the attachment coupling units 50 may be further provided with a width adjusting link 243. The width adjusting link 243 is provided for compatibly mounting a variety of buckets 240, in which the distances between the upper locking pin 241 and the lower locking pin 242 are different according to bucket manufacturers, to the attachment coupling units 50. The width adjusting link 243 is a link provided with respective pin locking structures in opposite ends. Described in detail, the first end of the width adjusting link 243 is provided with an upper locking pin 241 held in the upper locking hook 51, while the second end of the width adjusting link 243 is provided with a pinhole fitted over a self-locking pin 244 formed in the upper portion of the bucket 240. To mount the bucket 240 to the attachment coupling units 50 using the width adjusting link 243, the upper locking pin 241 of the width adjusting link 243 is inserted into the upper locking hook 51 and, thereafter, the width adjusting link 243 is swung upwards and downwards such that the pinhole of the width adjusting link 243 can be aligned with the self-locking pin 244 of the bucket 240 prior to locking the pinhole of the width adjusting link 243 to the self-locking pin 244 of the bucket 200. Therefore, the loader attachment coupling units 50 can be compatibly used with a variety of buckets 240 having different distances between the upper locking pin 241 and the lower locking pin 242 according to bucket manufacturers.

The attachment 200 may be selected from a variety of work attachments, which can be mounted to the loader 100 and may include forks (not shown) in addition to the above-mentioned fork pockets 210, the bale grippers 220, the bag hangers 230 and the buckets 240 typically used in farming and livestock farming.

Hereinbelow, the operation for laterally moving the left and right attachment coupling units 50 and the attachment 200 mounted to the attachment coupling units 50 to the left and right will be described with reference to FIG. 8, FIG. 9(*a*) through FIG. 9(*d*).

FIG. 8 is a front view illustrating a state of the attachment transfer device 20, which is viewed from the front of the attachment transfer device 20 (in a direction opposite to the forward direction of the cab of a tractor) and in which a bale gripper 220 as the attachment 200 is mounted to the attachment coupling units 50 in the attachment transfer device 20 and the hydraulic cylinder extendible rods 33 and 34 are extended to the left and right. As shown in FIG. 8, the hydraulic cylinder unit 30 is provided in the upper portion of the attachment transfer device 20, while the lateral moving unit 40 is provided in the lower portion of the attachment transfer device 20. To securely support both the hydraulic cylinder unit 30 and the lateral moving unit 40, fixed frames 60 are vertically mounted between the hydraulic cylinder unit 30 and the lateral moving unit 40 at predetermined respective locations.

Further, when the first and second hydraulic cylinders 35 and 36 are extended as shown in FIG. 8, the hydraulic cylinder extendible rods 33 and 34 are extended to the left and right along the driving lateral guide rails 31 and 32. In the above state, the lateral moving sliders 43 and 44 can be extended to the left and right by the attachment coupling units 50 vertically holding both the hydraulic cylinder extendible rods 33 and 34 and the lateral moving sliders 43 and 44. Because the lateral moving sliders 43 and 44 are extended to the left and right, the hydraulic cylinder extendible rods 33 and 34, the attachment coupling units 50 mounted to the lateral moving sliders 43 and 44, and the attachment (a bale gripper, 220) mounted to the attachment coupling units 50 can be laterally extended to the left and right along the driven guide rails 41 and 42.

In the present invention, it is preferred that the driving lateral guide rails 31 and 32 of the hydraulic cylinder unit 30 be laterally arranged with a lateral gap defined between them such that the operator sitting in the cab of the work vehicle can secure a clear and effective field of vision. Meanwhile, the driven lateral guide rails 41 and 42 of the lateral moving unit 40 are laterally arranged with a vertical gap defined between them.

As shown in FIG. 8, in order to prevent the pair of driven lateral guide rails 41 and 42 from being twisted and in order to reinforce the structural strength of the driven lateral guide rails 41 and 42 when the lateral moving sliders 43 and 44 laterally move along the pair of driven lateral guide rails 41 and 42, the front surfaces of the pair of driven lateral guide rails (the surfaces in the direction in which the attachment is mounted) are partially and axially open, while the remaining parts of the front surfaces thereof are closed. Further, although it is not shown in FIG. 8, in order to prevent the pair of driving lateral guide rails 31 and 32 from being twisted and in order to reinforce the structural strength of the driving lateral guide rails 31 and 32 when the hydraulic cylinder extendible rods 33 and 34 laterally move along the pair of driving lateral guide rails 31 and 32, the lower surfaces of the driving lateral guide rails 31 and 32 are partially and axially open, while remaining parts of the lower surfaces thereof are closed.

In the present invention, it is preferred that the length of the open axial part of each of the driving lateral guide rails 31, 32 and the driven lateral guide rails 41, 42 be almost equal to the length of the closed axial part thereof.

FIG. 9 is a view schematically illustrating the operation of the attachment mounting apparatus according to the present invention, in which FIG. 9(*a*) Illustrates left and right attachments (bale grippers, 220) mounted to the attachment coupling units 50 are in a fully leftward and rightward extended state; FIG. 9(*b*) illustrates a state in which the left and right attachments (bale grippers, 220) have been moved inwards to reduce the width between them so as to hold a thing, such as bagged rice-straw; FIG. 9(*c*) illustrates a state in which the left and right attachments (bale grippers, 220) have been moved inwards to reduce the width and hold the thing, such as the bagged rice-straw, and the left and right attachments (bale grippers, 220) have been moved to the left without changing the width; and FIG. 9(*d*) illustrates a state in which the left and right attachments (bale grippers, 220) have been moved inwards to reduce the width and hold the thing, such as the bagged rice-straw, and the left and right attachments (bale grippers, 220) have been moved to the right without changing the width.

As shown in FIGS. 6(*a*) and 6(*b*), the left and right attachments (bale grippers, 220) can be laterally moved in opposite directions or in the same direction. In the above state, the respective hydraulic cylinder units 30 for laterally moving the left and right attachments (bale grippers, 220) to the left and right may be operated to realize the same displacement of the attachments or to realize different displacements of the attachments. However, it is preferred that the respective hydraulic cylinder units 30 be operated to realize the same displacement of the left and right attachments. The operation illustrated in FIGS. 9(*a*) and 9(*b*) cannot be used in a pair of bag hangers 230 or a bucket 240, which is an integrated attachment 200 and is mounted as a single body to the left and right attachment coupling units 50, but can be used in a pair of fork pockets 210, a pair of bale grippers 220 or a pair of bag hangers 230, which are separately mounted to the respective left and right attachment coupling units 50.

Further, as shown in FIGS. 9(*c*) and 9(*d*), the whole parts of the left and right attachments (bale grippers, 220) may be laterally moved to the left and right in opposite directions (or in the same direction). In the above-mentioned operation, the respective hydraulic cylinder units 30 laterally moving the left and right attachments (bale grippers, 220) to the left and right must be operated to realize the same displacement of the two attachments. The operation illustrated in FIGS. 9(*c*) and 9(*d*) can be efficiently used in the bucket 240, which is the integrated attachment 200 and is mounted as a single body to the left and right attachment coupling units 50, in addition to the pair of fork pockets 210, the pair of bale grippers 220 and the pair of bag hangers 230, which are separately mounted to the respective left and right attachment coupling units 50.

The attachment mounting apparatus of the present invention capable of executing the above-mentioned operations is advantageous as follows.

When the pair of fork pockets 210 or the pair of bale grippers 220 are mounted to the left and right attachment coupling units 50 and are used for holding a thing, the width between the pair of fork pockets 210 or between the pair of bale gripper 220 can be adjusted. Further, the whole parts the pair of fork pockets 210 or the whole parts of the pair of bale grippers 220 can be laterally moved to the left or right in a state in which the attachments are holding the thing, thus improving work efficiency.

Further, to realize the same displacement (same extendible displacement) of the first and second hydraulic cylinders 35 and 36 of the hydraulic cylinder unit 30, the first and second hydraulic cylinders 35 and 36 may be commonly connected to part of hydraulic pressure lines 45, which supply actuating oil to the hydraulic cylinders 35 and 36, and may be controlled by respective hydraulic pressure controllers 46, as illustrated in the hydraulic circuit diagram of the hydraulic cylinders of FIG. 10. Described in detail, because the first and second hydraulic cylinders 35 and 36 are commonly connected to part of the hydraulic pressure lines 45, which supply actuating oil to the hydraulic cylinders 35 and 36, the hydraulic cylinder shafts 48 of the hydraulic cylinders 35 and 36 can be operated in conjunction with each other such that the shafts 48 can be moved leftwards and rightwards to the same displacement. Therefore, the hydraulic cylinder extendible rods 33 and 34 fixed to the respective hydraulic cylinder shafts 48 can be moved leftwards and rightwards to the same displacement.

In the present invention, to actuate the hydraulic cylinder units 30, four hydraulic pressure lines 45 are required. The four hydraulic pressure lines 45 may be efficiently used with four hydraulic pressure connection jacks 47, which are typically installed as surplus hydraulic pressure connection jacks in a movable work vehicle, such as a tractor, when the vehicle is delivered. When there is no surplus hydraulic pressure connection jack in the movable work vehicle, four hydraulic pressure connection jacks may be led from the main hydraulic pressure lines of the vehicle so as to be used with the four hydraulic pressure lines 45.

Further, a loader equipped with the above-mentioned loader attachment mounting apparatus for movable work vehicles is included in the scope of the present invention.

Another embodiment of the attachment mounting apparatus according to the present invention will be described hereinbelow with reference to FIGS. 11 through 14.

Figure 11:
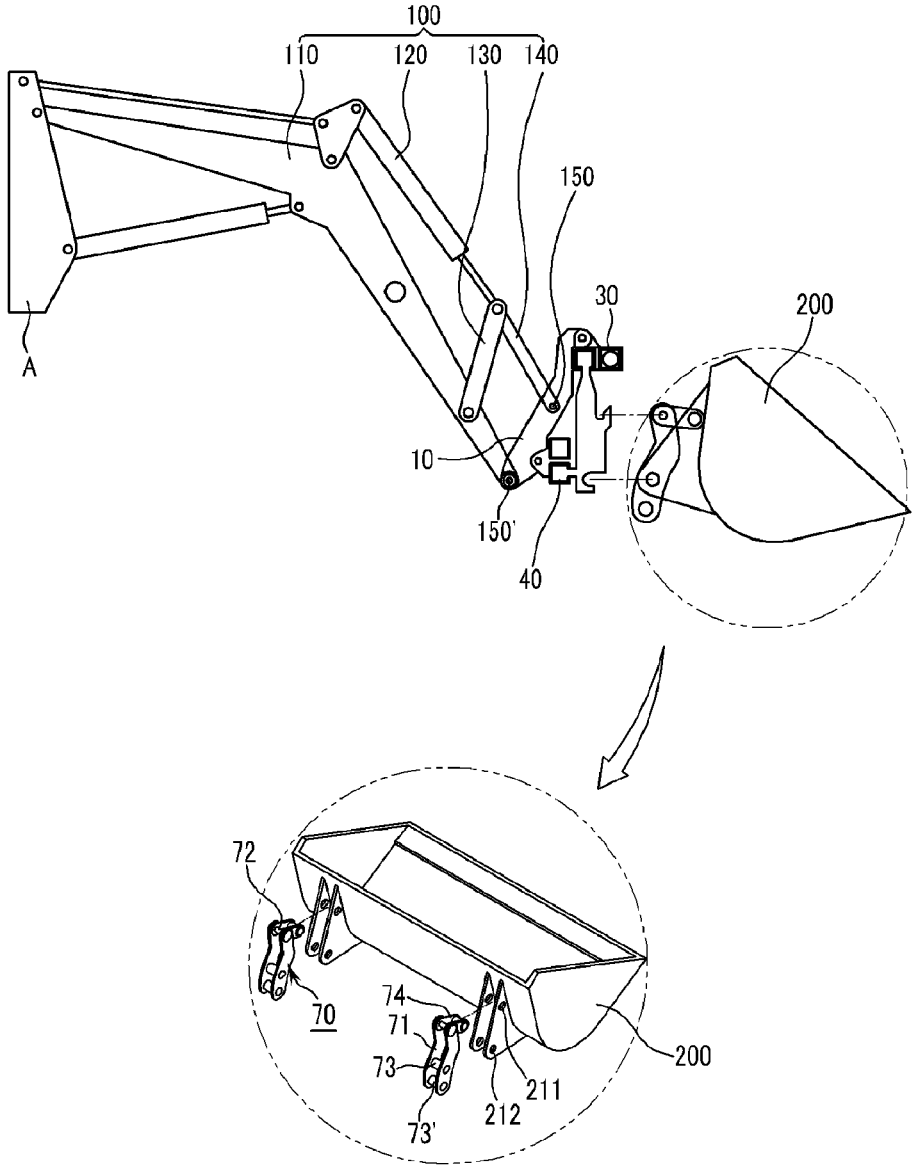
FIG. 11 is a side view illustrating a state in which an attachment (bucket) is mounted to the loader attachment mounting apparatus for movable work vehicles according to the present invention.

FIG. 11 is a side view illustrating a bucket, which is mounted to the attachment mounting apparatus mounted to the loader for movable work vehicles according to the present invention. In the embodiment of FIG. 11, the general shape except for the attachment 200, which uses a bucket 240 instead of the fork pockets 210, remains the same as that described for the embodiment of FIG. 1.

As shown in FIG. 11, when a bucket 240 is used as the attachment 200 mounted to the attachment coupling units 50, the width adjusting link 243 is installed between the attachment coupling units 50 and the bucket 240 such that a variety of buckets 240 having different distances between locking holes 245 and 246 of the bucket according to bucket manufactures can be compatibly mounted to the attachment coupling units 50. In this embodiment, the structure for mounting the bucket 240 to the attachment coupling units 50 remains the same as that described for the embodiment of FIG. 7.

Figure 12:
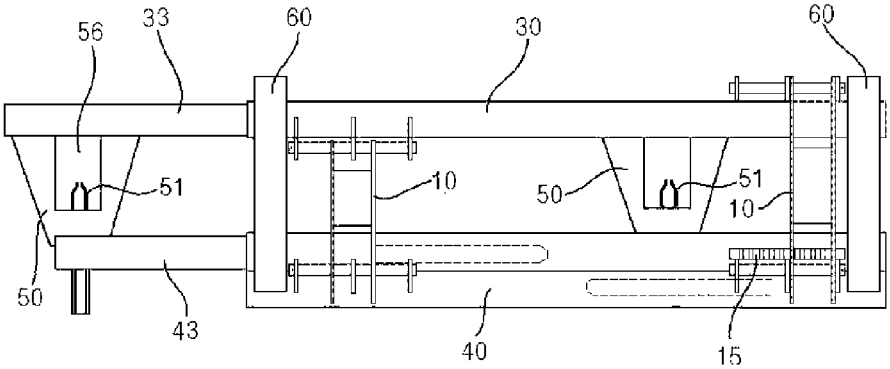
FIG. 12 is a front view illustrating an attachment mounting apparatus according to a second embodiment of the present invention when the apparatus is viewed from the cab of a vehicle.
Figure 13:
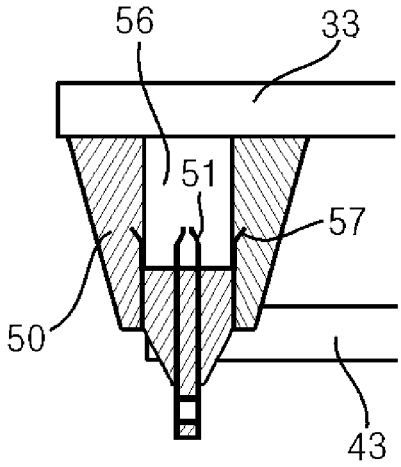
FIG. 13 is a front illustrating the attachment coupling unit according to the second embodiment of the present invention.

When the bucket 240 as the attachment 200 is mounted to the attachment coupling units 50 of the attachment mounting apparatus as shown in FIGS. 12 and 13, a hollow part 56 having a predetermined space is formed in the attachment coupling units 50 such that the operator sitting in the cab of the vehicle can see the mounted state of the bucket 240 relative to the attachment coupling units 50, thus easily executing the process of mounting the bucket 240 to the attachment coupling units 50 while sitting in the cab. Here, the operator can see the upper locking hooks 51 of the attachment coupling units 50 through the hollow part 56.

In the embodiment, the upper locking hooks 51 form the mounting holes in a pair of steel plates, which face each other with a predetermined space defined between them. Here, because the front ends of the upper locking hooks 51 formed in the pair of steel plates facing each other are inclined, the operator can more easily and clearly see the front ends of the locking hooks 51.

To mount the bucket 240 to the attachment coupling units 50, as shown in FIG. 12, the attachment coupling units 50 are moved to the left (or to the right) by actuating the attachment transfer device 20 such that the hollow part 56 of the attachment coupling unit 50 can be caught by the eyes of the operator sitting in the cab. Thereafter, the operator mounts the bucket 240 to the attachment coupling units 50 while seeing the upper locking hooks 51 through the hollow part 56.

Because the hollow part 56 having the predetermined space is formed in the attachment coupling units 50 as described above, the operator can easily and clearly see the upper locking hooks 51 of the attachment coupling units 50 while sitting in the cab, so that the operator can easily and reliably mount the bucket 240 to the attachment mounting apparatus by moving the attachment mounting apparatus forwards, backwards, leftwards and rightwards without requiring an addition by an assistant.

Further, to more firmly mount the attachment 200 to the attachment coupling units 50, the attachment coupling units 50 may further include a pair of sub-locking hooks 57 in the left and right sides of the upper locking hooks 51 to which the attachment 200 is mounted. Further, it is preferred that the front ends of the sub-locking hooks 57 be inclined outwards.

When protruding extensions are formed in the upper hollow locking holes 72 of the width adjusting links 70 used for mounting the attachment 200 in such a way that the protruding extensions are extended outwards, the attachment (bucket) 200 can be more firmly mounted to the attachment coupling units 50 by inserting the protruding extensions into the pair of sub-locking hooks 57.

Figure 14:
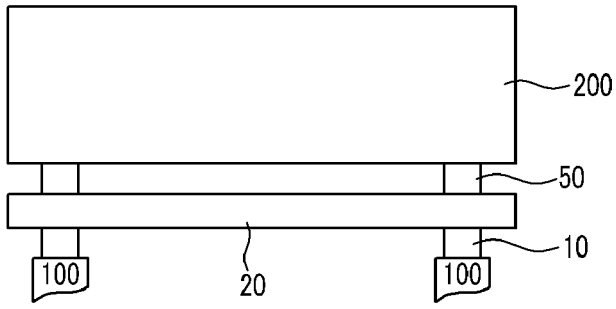
FIG. 14 is a view illustrating the operation of a bucket mounted to the attachment mounting apparatus according to the present invention.
Figure 14:
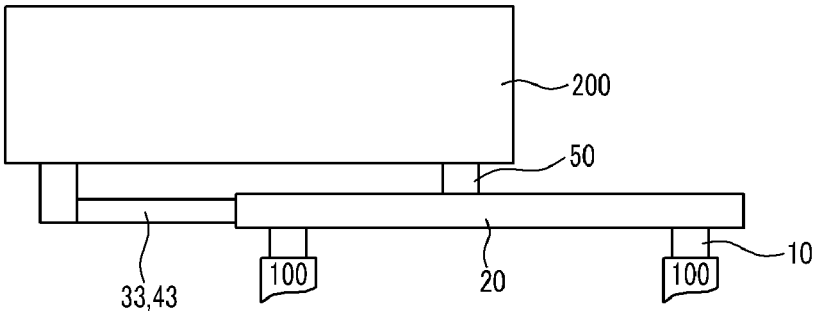
Figure 14:
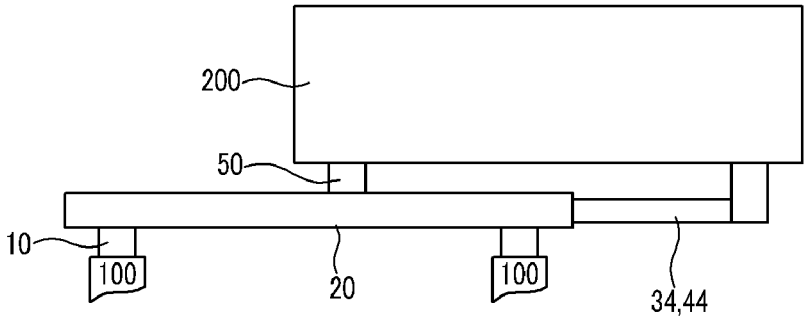

FIG. 14 is a view illustrating the operation of the bucket 200 mounted to the attachment mounting apparatus of the present invention. This drawing is a plane view viewed from the top above the bucket mounted to the attachment mounting apparatus.

The operation of the structure for moving the bucket 240, which is mounted as the attachment 200 to the attachment mounting apparatus of the present invention, to the left and right will be described hereinbelow with reference to FIG. 14.

As shown in FIG. 14(*a*), the left and right attachment coupling brackets 10 are mounted on the first surfaces thereof to the left and right front ends 150 and 150' of the loader 100. Further, the attachment transfer device 20 including both the hydraulic cylinder unit 30 and the lateral moving unit 40 is mounted to the second surfaces of the left and right attachment coupling brackets 10. The attachment transfer device 20 further includes the attachment coupling units 50, which are mounted both to the hydraulic cylinder unit 30 and to the lateral moving unit 40, and mount the attachment (bucket) 240 to the attachment mounting apparatus such that, when the hydraulic cylinder unit 30 is laterally moved to the left or right, the mounted attachment (bucket) 240 can be laterally moved in the same direction.

In other words, when the hydraulic cylinder unit 30 is laterally moved to the left, the mounted attachment (bucket) 240 can be laterally moved to the left, as shown in FIG. 5(*b*). Meanwhile, when the hydraulic cylinder unit 30 is laterally moved to the right, the mounted attachment (bucket) 240 can be laterally moved to the right, as shown in FIG. 5(*c*).

When the attachment 200 uses a bucket 240, the left and right attachment coupling units 50 are commonly connected to the single bucket 240, so that the hydraulic cylinder extendible rods 33 and 34 of the hydraulic cylinder unit 30 must be moved to the same displacement. However, when the attachment 200 uses a pair of bale grippers, a pair of fork pockets or a pair of bag hangers, which are separately mounted to the left and right attachment coupling units 50, it is not necessary to move the hydraulic cylinder extendible rods 33 and 34 of the hydraulic cylinder unit 30 to the same displacement.

Although the embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides the loader attachment mounting apparatus for movable work vehicles and the loader equipped with the loader attachment mounting apparatus, in which the loader attachment mounting apparatus is used for mounting a work attachment, such as a bale gripper, a bucket or a hook, to the front end of a loader movably mounted to the front surface of the movable work vehicles, such as a tractor, in such a way that the loader can be rotatable upwards and downwards. Particularly, in the loader attachment mounting apparatus for movable work vehicles and the loader equipped with the attachment mounting apparatus according to the present invention, the attachment can be easily attached to and easily detached from the attachment mounting apparatus and the attachment mounted to the loader can be easily moved to the left and right, thus improving work efficiency and work reliability of the movable work vehicles. The present invention may efficiently used in the agricultural machine industry.

The invention claimed is:

1. An attachment mounting apparatus for movable work vehicles, which is mounted to left and right front ends of a loader mounted to a front surface of a movable work vehicle, and is used for attaching or detaching an external attachment to or from the loader, the attachment mounting apparatus comprising:

left and right attachment coupling brackets connected on first surfaces thereof to the left and right front ends of the loader; and an attachment transfer device including left and right attachment coupling units, which are connected to second surfaces of the left and right attachment coupling brackets and attach or detach the external attachment, and are laterally movable in a same direction or in opposite directions, wherein the attachment transfer device comprises:

left and right upper mounting parts and left and right lower mounting parts mounted to upper and lower parts of the second surfaces of the left and right attachment coupling brackets;

a hydraulic cylinder unit comprising: a pair of hydraulic cylinder extendible rods being laterally movable to left and right along a pair of driving lateral guide rails fixed in the left and right upper mounting parts; and a first hydraulic cylinder and a second hydraulic cylinder moving the hydraulic cylinder extendible rods in lateral directions;

a lateral moving unit comprising a pair of lateral moving sliders being laterally movable to left and right along a pair of driven lateral guide rails fixed in the left and right lower mounting parts;

left and right attachment coupling units having a structure for attaching and detaching the external attachment, and vertically connecting the pair of hydraulic cylinder extendible rods to the pair of lateral moving sliders in such a way that the pair of hydraulic cylinder extendible rods can be laterally moved by extendible motions of the first and second hydraulic cylinders and thereby can laterally move the lateral moving sliders connected to the hydraulic cylinder extendible rods.

2. The attachment mounting apparatus for movable work vehicles as set forth in claim 1, wherein, when the left and right attachment coupling units are laterally moved in the same direction or in the opposite directions, the left and right attachment coupling units are moved by a same displacement.

3. The attachment mounting apparatus for movable work vehicles as set forth in claim 2, wherein the external attachment is a pair of fork pockets, a pair of bale grippers, a pair of bag hangers, a bucket or a fork.

4. The attachment mounting apparatus for movable work vehicles as set forth in claim 1, wherein the pair of driving lateral guide rails of the hydraulic cylinder unit are laterally arranged with a lateral gap defined between them, while the pair of driven lateral guide rails of the lateral moving unit are laterally arranged with a vertical gap defined between them.

5. The attachment mounting apparatus for movable work vehicles as set forth in claim 1, wherein lower surfaces of the pair of driving lateral guide rails are partially and axially open, while remaining parts of the lower surfaces thereof are closed, and front surfaces (surfaces to which the attachment is being attached) of the pair of driven lateral guide rails are partially and axially opened, while remaining parts of the front surfaces thereof are axially closed.

6. The attachment mounting apparatus for movable work vehicles as set forth in claim 5, wherein the external attachment is a pair of fork pockets, a pair of bale grippers, a pair of bag hangers, a bucket or a fork.

7. The attachment mounting apparatus for movable work vehicles as set forth in claim 1, wherein the attachment coupling unit is provided with an upper locking hook and a lower locking hook, so that the attachment can be mounted to the attachment coupling unit.

8. The attachment mounting apparatus for movable work vehicles as set forth in claim 7, wherein the upper or lower locking hook attaches or detaches the attachment by projecting or retracting a restraining jaw using a releasing lever elastically biased by an elastic member.

9. The attachment mounting apparatus for movable work vehicles as set forth in claim 8, wherein the external attachment is a pair of fork pockets, a pair of bale grippers, a pair of bag hangers, a bucket or a fork.

10. A loader attachment mounting apparatus for movable work vehicles, which is mounted to left and right front ends of a loader mounted to a front surface of a movable work vehicle, and is used for attaching or detaching an external attachment, the attachment mounting apparatus comprising:

left and right attachment coupling brackets connected on first surfaces thereof to the left and right front ends of the loader;

an attachment transfer device including: left and right upper mounting parts and left and right lower mounting parts connected to upper and lower portions of second surfaces of the left and right attachment coupling brackets; and left and right attachment coupling units attaching and detaching the external attachment and being laterally movable by a pair of hydraulic cylinders, wherein the upper mounting parts or the lower mounting parts are connected to the attachment coupling brackets by mounting pins and further comprise: a plurality of mounting holes capable of realizing a width adjustment, so that the attachment transfer device can be compatibly mounted to a variety of loaders having different width according to manufacturers;

a lateral moving unit comprising a pair of lateral moving sliders being laterally movable to left and right along a pair of driven lateral guide rails fixed in the left and right lower mounting parts; and left and right attachment coupling units having a structure for attaching and detaching the external attachment, and vertically connecting the pair of hydraulic cylinder extendible rods to the pair of lateral moving sliders in such a way that the pair of hydraulic cylinder extendible rods can be laterally moved by extendible motions of the first and second hydraulic cylinders and thereby can laterally move the lateral moving sliders connected to the hydraulic cylinder extendible rods.

11. The attachment mounting apparatus for movable work vehicles as set forth in claim 10, wherein the attachment is a pair of fork pockets, a pair of bale grippers, a pair of bag hangers, a bucket or a fork.

12. An attachment mounting apparatus mounted to a loader for movable work vehicles, which is mounted to left and right front ends of the loader mounted to a front surface of a movable work vehicle, and is used for attaching or detaching an external attachment to or from the loader, the attachment mounting apparatus comprising:

left and right attachment coupling brackets connected on first surfaces thereof to the left and right front ends of the loader; left and right attachment coupling units mounted to the left and right attachment coupling brackets at locations opposite to the loader and attaching or detaching the attachment; and an attachment transfer device for laterally moving the left and right attachment coupling units in a same direction or in opposite directions, wherein the attachment coupling units is provided with a hollow part for allowing an operator of the movable work vehicle to see an upper locking hook, which is being locked to the external attachment, through the hollow part while sitting in a cab of the movable work vehicle;

a lateral moving unit comprising a pair of lateral moving sliders being laterally movable to left and right along a pair of driven lateral guide rails fixed in left and right lower mounting parts; and left and right attachment coupling units having a structure for attaching and detaching the external attachment, and vertically connecting a pair of hydraulic cylinder extendible rods to the pair of lateral moving sliders in such a way that the pair of hydraulic cylinder extendible rods can be laterally moved by extendible motions of the first and second hydraulic cylinders and thereby can laterally move the lateral moving sliders connected to the hydraulic cylinder extendible rods.

13. The attachment mounting apparatus mounted to the loader for movable work vehicles as set forth in claim 12, wherein the upper locking hook is configured such that a front end thereof is inclined.

14. The attachment mounting apparatus mounted to the loader for movable work vehicles as set forth in claim 13, wherein the attachment coupling unit further comprises: sub-locking hooks provided in left and right sides of the upper locking hook locked to the attachment.

15. The attachment mounting apparatus mounted to the loader for movable work vehicles as set forth in claim 12, wherein the attachment coupling unit further comprises: sub-locking hooks provided in left and right sides of the upper locking hook locked to the attachment.

* * * * *